114-253 SR
4/19/88 XR 4,738,216

United States Patent [19]
Camarota et al.

[11] Patent Number: 4,738,216
[45] Date of Patent: Apr. 19, 1988

[54] ANCHOR FOR WATER SKI TOW ROPE

[75] Inventors: Richard J. Camarota; James H. Miller, both of Holland, Mich.

[73] Assignee: ITC, Incorporated, Zeeland, Mich.

[21] Appl. No.: 935,748

[22] Filed: Nov. 28, 1986

[51] Int. Cl.[4] ..... B63B 21/58
[52] U.S. Cl. ..... 114/249; 24/115 K; 248/499; D12/317; D12/162; D8/382; 114/253; 114/218
[58] Field of Search ..... 114/218, 230, 242, 249, 114/251-253, 381; 441/68, 69; 24/15 K, 265 CD, 129 R, 130; 410/101, 106, 108, 109, 110, 112, 113, 114, 115, 116; 248/499; D8/356, 382; D12/317, 162

[56] References Cited

U.S. PATENT DOCUMENTS

| | | | |
|---|---|---|---|
| 18,107 | 9/1857 | Seaman | 114/252 |
| D. 32,957 | 7/1900 | Lewis | D8/382 |
| D. 187,057 | 1/1960 | Griparis | D12/162 |
| 926,405 | 6/1909 | Gould | 24/130 |
| 2,962,998 | 12/1960 | Long | 114/218 |
| 3,353,232 | 11/1967 | Brownson | 24/129 R |
| 3,890,918 | 6/1975 | Sell | 114/253 |

*Primary Examiner*—Sherman D. Basinger
*Assistant Examiner*—Paul E. Salmon
*Attorney, Agent, or Firm*—Price, Heneveld, Cooper, DeWitt & Litton

[57] ABSTRACT

A rope anchor for use in situations in which frequent attachment and removal of the rope is required. The anchor has a U-shaped bracket which is secured to a support such as the transom of a boat. The bracket has a central finger midway between and parallel to the bracket legs. The portion of the finger adjacent its attachment to the closed end of the bracket is in the same plane as the bracket legs but the inner end of the finger is bent out of this plane at a minor angle. The legs have stops which position the bracket such that the end of the finger is so spaced from the surface of the bracket support as to create a passage for the rope less than the normal diameter of the rope but large enough to permit the rope to be passed through it when the rope has been diametrically squeezed in one direction. This prevents inadvertent release of the rope when it is slack.

11 Claims, 1 Drawing Sheet

ANCHOR FOR WATER SKI TOW ROPE

FIELD OF THE INVENTION

The invention relates to rope anchors and, more particularly, to a rope anchor specifically designed for detachably securing ropes such as a water-ski tow rope to a boat.

BACKGROUND OF THE INVENTION

Numerous fittings have been designed to provide means of securing ropes, such as ski tow ropes, to the transom of a boat. Because these ropes are removed each time the use of the rope for skiing ends, it is not feasible to attach them by the use of conventional knots. Therefore, the common practice is to provide the rope with a latch mechanism which can serve as a quick attachment and release from the anchor member. While this system is functionally acceptable, it is relatively expensive and clumsy compared to the use of a rope with a simple loop on the end which could be secured to the anchor bracket on the boat. It is also important that the means used to replace the present conventional latch be both relatively easy to operate and secure against unintentional release.

BRIEF DESCRIPTION OF THE INVENTION

The invention provides a U-shaped bracket with a finger in the center so designed that a rope can be passed through the bracket and engaged around the finger to secure it yet prevent release, except as a result of intentional manipulation of the rope for the express purpose of releasing it. The invention provides a means of quickly and easily releasing the rope by passing it between the anchor finger within the bracket and the face of the transom or other structure with which the anchor means is utilized. In this manner, a rope with a simple loop at the end can be quickly and easily secured and released but can be depended upon to retain the rope unless the release is intentional. The invention is effective for securing the rope, irrespective of whether the bracket is mounted horizontally or vertically. It is also equally effective whether the surface to which it is mounted is vertical or inclined.

DESCRIPTION OF THE PREFERRED EMBODIMENT

Figure 1:
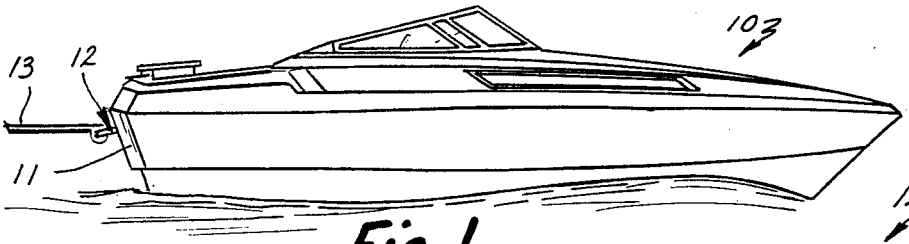
FIG. 1 is a side elevation view of a boat equipped with this invention.

Referring to FIG. 1, the numeral 10 indicates a boat having a transom 11 on which has been mounted an anchor bracket 12 incorporating this invention. In FIG. 1, the anchor bracket is illustrated as securing the end of a rope 13, such as would be used for water skiing. It will be recognized that the specific purpose for which the rope is used is not relevant to the invention.

Figure 2:
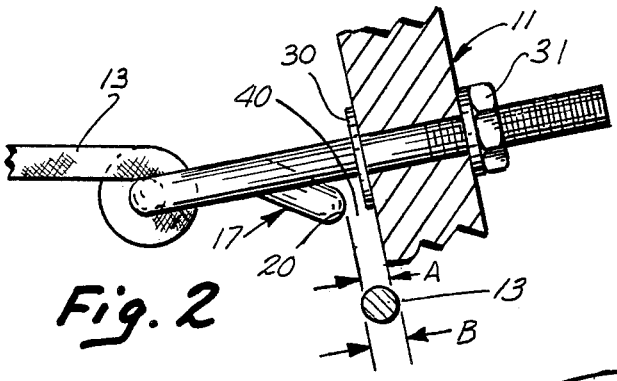
FIG. 2 is an enlarged fragmentary sectional elevation view of the rope anchor bracket illustrated in FIG. 1.
Figure 3:
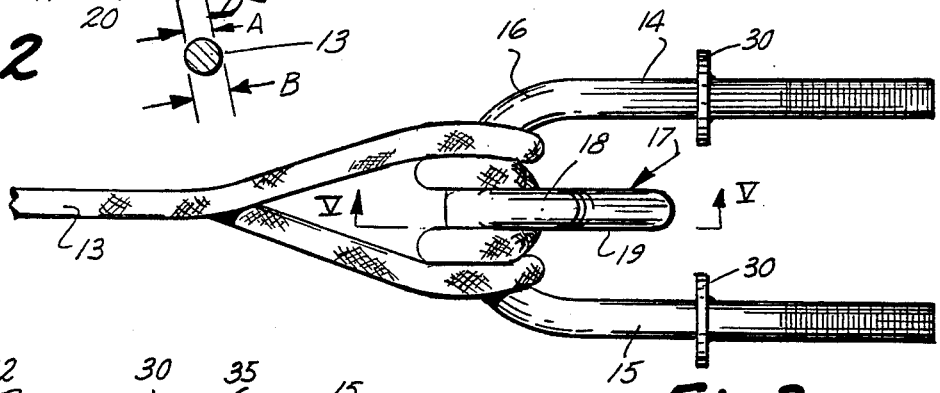
FIG. 3 is a plan view of the invention with a rope secured to it.
Figure 4:
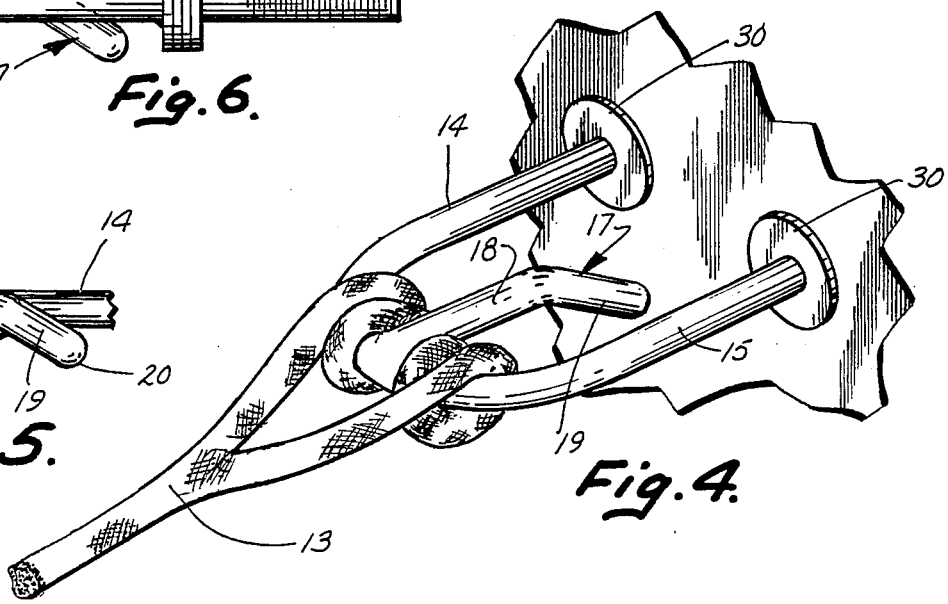
FIG. 4 is a fragmentary oblique view of the invention with rope attached.

The bracket 12 is illustrated in greater detail in FIGS. 3 and 4 and consists of a body having a pair of legs 14 and 15, joined by a cross member 16 which, in the particular construction illustrated, is a curved integral extension of the legs, thus forming a generally U-shaped structure. Extending parallel to the legs 14 and 15 and preferably midway between them is a finger 17. This finger extends toward the free ends of the legs and adjacent the cross member 16 and has a portion 18 which is in the same plane as the legs 13 and 14 and a second portion 19 which is inclined to this plane at a minor angle. A preferred angle of inclination of the finger portion 19 is about 30°. The finger 17 terminates in a rounded end 20. In the anchor bracket construction illustrated in FIGS. 2–4, a stop member 30 is secured to each of the legs 14 and 15 by suitable means, such as welding. The stop members 30 can be washers or washer like collars welded, one to each of the legs. The free ends of the legs 14 and 15 remote from the cross member 16 are threaded to receive the nuts 31. The threading of the legs can be extended toward the cross member 16 to permit the use of nuts as stops as substitutes for the welded stops 30. This will permit adjustment of the width of the hereinafter described passage A.

The anchor bracket 12 can be secured to the boat with the inclined portion 19 of the finger extending either downwardly or upwardly. Whether the transom is vertical or inclined does not matter with respect to the direction of inclination of the finger 19, as will be explained subsequently. While FIG. 1 illustrates the anchor bracket with the legs of the bracket where they penetrate the transom being arranged generally horizontally, that is, parallel to the water surface, this invention will function properly even though the bracket is mounted with legs spaced vertically rather than horizontally. It will also operate at any angular position between horizontal and vertical.

In mounting the anchor bracket, the legs 14 and 15 are passed through suitable openings in the transom and are secured by the nuts 31 mounted on the threaded ends of the legs to draw the stops 30 tightly against the exterior face of the transom (FIG. 2). Preferably, washers are used between the nuts and the transom surface on the inside to increase the bearing area and reduce damage to the surface of the transom as a result of tightening the nuts.

When the rope has been secured to the anchor bracket, it is restrained from inadvertent or unintentional release when the rope is slack by the existence of the finger 17 and its shape. The rope can only become released when it is slacked so that the end of the loop can pass around the end 20 of the finger through the passage 40 between it and the surface of the transom. Thus, if the anchor bracket is mounted, as illustrated in FIG. 2, with the finger inclined downwardly, any tension applied to the rope will tend to pull the loop toward the fixed end of the finger and against the cross member. The same is true when the bracket is so mounted that the inclined end of the finger extends upwardly. The key to preventing the rope from accidental disengagement is the spacing A between the transom and the end 20 of the finger (FIG. 2). It will be noted in this Figure that the diameter B of the rope is significantly greater than the gap or passage A. This excess of diameter must be such as to positively resist movement of the rope through the passage unless an intentionally applied intervening force is exerted on it such as an operator squeezing the rope. However, the excess of diameter must not be so great that the rope cannot be made to compress and squeeze through the passage 40. This type of interference between the rope and the sides of the passage is enough to positively prevent the rope from passing through the passage A when the rope is slack. Restricting the width of the passage A to less than the normal diameter of the rope 13 is effective to prevent unintentional release irrespective of the orientation of the anchor bracket. The rounding of the end 20 of the finger 17 contributes to the result because it eliminates the possibility of the rope becoming snagged on the sharp edges of a square cut end.

Figure 7:
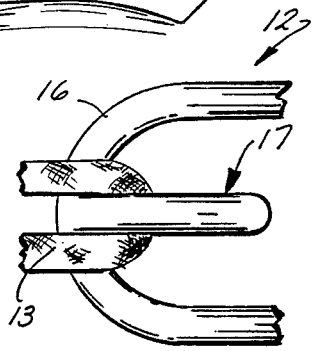
FIG. 7 is a fragmentary view of a modified attachment of the rope to the anchor bracket.

The preferred method of securing the rope to the anchor bracket is illustrated in FIGS. 2, 3 and 4. In this method, the loop is first passed over the top of the cross member 16, squeezed and passed between the end 20 of the finger and the transom and then passed under and around the exterior of the cross member and once again down through the passage A and then pulled tight to eliminate the slack. This arrangement, requiring a dual passage through the gap A is substantially impossible to release without careful and intentional intervention. In fact, even if the rope secured as illustrated in FIG. 4 for some reason managed to effect release from the first transit through the passage A it would still be secured as illustrated in FIG. 7. In fact, having secured the rope as illustrated in FIG. 7, making the second pass through the passage A is more a matter of insurance rather than necessity except when the bracket is positioned with its leg spaced vertically. In this later circumstance, the weight of the rope does not necessarily cooperate in helping to prevent the rope inadvertently working its way through the passage.

When it is desired to detach the rope, its removal is accomplished simply by reversing the process of attachment, that is, by passing the end of the loop once or twice, depending upon how it was initially secured, through the passage A in the reverse direction.

Figure 6:
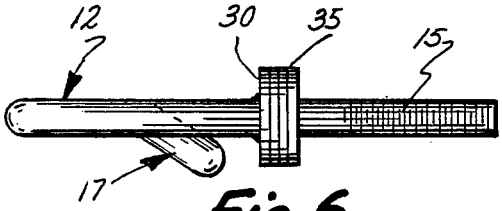
FIG. 6 is a side elevation view illustrating a modified form of the invention.
Figure 5:
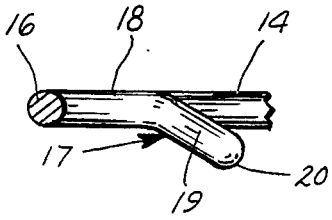
FIG. 5 is a fragmentary, sectional elevation view taken along the plane V—V of FIG. 3.

FIG. 6 illustrates one method of adapting the invention to ropes of different diameters. While the passage A will be set for the rope diameter with which the bracket is normally expected to be used, the bracket can be adjusted at point of installation for use with ropes of greater diameter by placing one or more spacers or washers 35 between the stops 30 and the transom to provide the necessary increase in the width of the passage.

It will be recognized that the invention provides a rope anchor of simple design, permitting easy rope attachment and removal capable of a wide range of uses. While waterskiing has been specifically mentioned, such use is only illustrative and in no way limits the utility of the invention.

Having described the preferred embodiment of the invention, it will be recognized that modifications of it can be made without departing from the principles of the invention, such modifications are to be considered as included in the hereinafter appended claims, unless these claims by their language expressly state otherwise.

We claim:

1. Anchor means for a rope adapted to be mounted on a support surface, said rope having a loop at one end for attachment to said anchor means, said anchor means having a pair of parallel legs in a first common plane each having a free end and rigidly joined at their other ends by a cross member forming a generally U-shaped body, stop means on each of said legs intermediate its ends; said stop means each having a stop surface facing said free ends, said stop surfaces being arranged in a second common plane and adapted to seat against said support surface; a finger rigidly fixed to said cross member substantially midway between said legs and extending in the same general direction as said legs, said finger having a first portion extending in said first common plane and a second portion inclined at a minor angle to said first common plate; said finger having a free end spaced from said second common plane a distance less than an uncompressed diameter of the rope with which said anchor means is to be used to prevent escape of the rope through a passage defined between the end of said finger and said support surface.

2. A rope anchor means as described in claim 1 wherein when the anchor means is mounted the second common plane of the stop means is coincident with the plane of said support surface.

3. The combination of the rope anchor means as described in claim 2 and the rope, said rope being made of a material permitting limited diametric reduction in one transverse direction due to diametric compression, said rope having said loop on one end which loop passes over one surface of said cross member on each side of said finger, and around a surface of said finger facing away from said one surface of the cross member.

4. The combination described in claim 3 wherein said loop passes entirely around said cross member on each side of said finger and also around the surface of said finger facing away from said one surface of the cross member.

5. The rope anchor means described in claim 2 wherein one or more spacer means are mounted on each of said legs to seat against said stop surfaces of said stop means for adjusting the spacing between the free end of said finger and said support surface to accommodate the use of ropes of different diameters.

6. A rope anchor means as described in claim 1 wherein said stop means are rigidly secured to said legs.

7. A rope anchor means as described in claim 1 wherein elements are provided for moving the stop surfaces of said stop means along said legs to adjust the spacing between said second common plane and said support surface to accommodate ropes of different diameters.

8. A rope anchor means as described in claim 1 wherein the free end of the finger is smoothly rounded.

9. A rope anchor means as described in claim 1 wherein the free ends of said legs are threaded, and nuts are provided on said legs pulling said stop surfaces of said stop means tightly against the support surface on which the anchor means is mounted.

10. Anchor means for securing a rope to the upwardly extending transom of a boat, the rope having a loop at one end for attachment to said anchor means, said anchor means having a pair of parallel legs in a first common plane each having a free end and rigidly joined at their other ends by a cross member forming a generally U-shaped body, stop means on each of said legs intermediate its ends; said stop means each having a stop surface facing said free ends, said stop surfaces being arranged in a second common plane and adapted to seat against a surface of said transom; a finger rigidly fixed to said cross member substantially midway between said legs and extending in the same general direction as said legs, said finger having a first portion extending in the first common plane and a second portion inclined at a minor angle to said first common plane; said finger having a free end spaced from the second common plane a distance less than an uncompressed diameter of the rope with which said anchor is to be used to prevent escape of the rope through a passage defined between the end of said finger and said surface of said transom.

11. Anchor means for securing a rope to the upwardly extending transom of a boat, the rope having a loop at one end for attachment to said anchor means, said anchor means having a pair of parallel legs each having a free end and rigidly joined at their other ends by a cross member forming a generally U-shaped body, stop means on each of said legs intermediate its ends; said stop means each having a stop surface facing said free ends, said stop surfaces being arranged in a common plane and adapted to seat against a surface of said transom; a finger rigidly fixed to said cross member substantially midway between said legs and extending in the same general direction as said legs, said finger having a free end spaced from the common plane of the stop surfaces a distance less than an uncompressed diameter of the rope with which said anchor is to be used to prevent escape of the rope through a passage defined between the end of said finger and said surface of said transom.

* * * * *

UNITED STATES PATENT AND TRADEMARK OFFICE

CERTIFICATE OF CORRECTION

PATENT NO. : 4,738,216

DATED : April 19, 1988

INVENTOR(S) : Richard J. Camarota & James H. Miller

It is certified that error appears in the above-identified patent and that said Letters Patent is hereby corrected as shown below:

Column 4, Claim 1, Line 13:
"plate" should be "plane".

Signed and Sealed this

Eighteenth Day of October, 1988

*Attest:*

DONALD J. QUIGG

*Attesting Officer*

*Commissioner of Patents and Trademarks*